US010739053B2

(12) United States Patent
Jimenez et al.

(10) Patent No.: US 10,739,053 B2
(45) Date of Patent: Aug. 11, 2020

(54) ICE-MAKING APPLIANCE

(71) Applicant: WHIRLPOOL CORPORATION, Benton Harbor, MI (US)

(72) Inventors: Benjamin G. Jimenez, Burns Harbor, MI (US); Anuj Sharma, St. Joseph, MI (US); Rishikesh Vinayak Kulkarni, St. Joseph, MI (US); Darci Cavali, St. Joseph, MI (US); Ayodhya Ram, Pune (IN); Richard A. Spletzer, St. Joseph, MI (US); Mahalingappa Mulimani, Pune (IN); Rogerio Rodrigues, Jr., Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 96 days.

(21) Appl. No.: 15/810,470

(22) Filed: Nov. 13, 2017

(65) Prior Publication Data

US 2019/0145683 A1 May 16, 2019

(51) Int. Cl.

| | |
|---|---|
| ***F25C 1/24*** | (2018.01) |
| ***F25C 5/06*** | (2006.01) |
| ***F25C 1/04*** | (2018.01) |

(52) U.S. Cl.

CPC ..... *F25C 1/24* (2013.01); *F25C 1/04* (2013.01); *F25C 5/06* (2013.01); *F25C 2400/10* (2013.01); *F25C 2500/08* (2013.01); *F25C 2700/12* (2013.01); *F25D 2317/063* (2013.01)

(58) Field of Classification Search

CPC ..... F25C 1/24; F25C 1/04; F25D 2317/063

See application file for complete search history.

(56) References Cited

U.S. PATENT DOCUMENTS

| | | | |
|---|---|---|---|
| 275,192 | A | 4/1883 | Goodell |
| 286,604 | A | 10/1883 | Goodell |
| 301,539 | A | 7/1884 | Vezin |
| 1,407,614 | A | 2/1922 | Wicks |
| 1,616,492 | A | 2/1927 | Lado |
| 1,889,481 | A | 11/1932 | Kennedy, Jr. |
| 1,932,731 | A | 10/1933 | Hathome |
| 2,027,754 | A | 1/1936 | Smith |
| 2,244,081 | A | 3/1938 | Reeves |
| 2,617,269 | A | 6/1949 | Smith-Johannsen |
| 2,481,525 | A | 9/1949 | Mott |

(Continued)

FOREIGN PATENT DOCUMENTS

| | | | |
|---|---|---|---|
| AU | 2006201786 | A1 | 11/2007 |
| CN | 1989379 | A | 6/2007 |

(Continued)

*Primary Examiner* — Ana M Vazquez

(74) *Attorney, Agent, or Firm* — Price Heneveld LLP

(57) ABSTRACT

An icemaker for a refrigerated appliance is provided herein. The icemaker includes an ice tray having a plurality of ice-forming compartments. Each of the ice-forming compartments includes sidewalls and a base that defines an internal freezing chamber. A duct system has upper and lower baffles. The upper baffle directs chilled air above the ice tray and the lower baffle directs chilled air below the ice tray. A deflector is operably coupled with the upper baffle. The deflector has a transition portion offset from a body portion. A diverter is disposed between the deflector and the ice tray. The diverter defines a plurality of variously sized slots therein.

20 Claims, 10 Drawing Sheets

(56) References Cited

U.S. PATENT DOCUMENTS 2,757,519 A 2/1954 Sampson
2,846,854 A 2/1954 Galin
2,683,356 A 7/1954 Green, Jr.
2,878,659 A 7/1955 Prance et al.
2,942,432 A 6/1960 Muffiy
2,969,654 A 1/1961 Harte
2,996,895 A 8/1961 Lippincott
3,009,336 A 11/1961 Bayston et al.
3,016,719 A 1/1962 Reindl
3,033,008 A 5/1962 Davis
3,046,753 A 7/1962 Carapico, Jr.
3,071,933 A 1/1963 Shoemaker
3,075,360 A 1/1963 Elfving et al.
3,075,364 A 1/1963 Kniffin
3,084,678 A 4/1963 Lindsay
3,084,878 A 4/1963 Helming et al.
3,093,980 A 6/1963 Frei
3,144,755 A 8/1964 Kattis
3,159,985 A 12/1964 Keighley
3,172,269 A 3/1965 Cole
3,192,726 A 7/1965 Newton
3,200,600 A 8/1965 Elfving
3,214,128 A 10/1965 Beck et al.
3,217,508 A 11/1965 Beck et al.
3,217,510 A 11/1965 Kniffin et al.
3,217,511 A 11/1965 Keighley
3,222,902 A 12/1965 Brejcha et al.
3,228,222 A 1/1966 Maier
3,255,603 A 6/1966 Johnson et al.
3,306,064 A 2/1967 Poolos
3,308,631 A 3/1967 Kniffin
3,318,105 A 5/1967 Burroughs et al.
3,321,932 A 5/1967 Orphey, Jr.
3,383,876 A 5/1968 Frohbieter
3,412,572 A 11/1968 Kesling
3,426,564 A 2/1969 Jansen et al.
3,451,237 A 6/1969 Baringer et al.
3,638,451 A 2/1972 Brandt
3,646,792 A 3/1972 Hertel et al.
3,648,964 A 3/1972 Fox
3,667,249 A * 6/1972 Brown ..... F25C 5/185
62/312
3,677,030 A 7/1972 Nicholas
3,684,235 A 8/1972 Schupbach
3,775,992 A 12/1973 Bright
3,788,089 A 1/1974 Graves
3,806,077 A 4/1974 Pietrzak et al.
3,864,933 A 2/1975 Bright
3,892,105 A 7/1975 Bernard
3,908,395 A 9/1975 Hobbs
3,952,539 A 4/1976 Hanson et al.
4,006,605 A 2/1977 Dickson et al.
D244,275 S 5/1977 Gurbin
4,024,744 A 5/1977 Trakhtenberg et al.
4,059,970 A 11/1977 Loeb
4,062,201 A 12/1977 Schumacher et al.
4,078,450 A 3/1978 Vallejos
D249,269 S 9/1978 Pitts
4,142,378 A 3/1979 Bright et al.
4,148,457 A 4/1979 Gurbin
4,184,339 A 1/1980 Wessa
4,222,547 A 9/1980 Lalonde
4,261,182 A 4/1981 Elliott
4,288,497 A 9/1981 Tanaka et al.
4,402,185 A 9/1983 Perchak
4,402,194 A 9/1983 Kuwako et al.
4,412,429 A 11/1983 Kohl
4,462,345 A 7/1984 Routery
4,483,153 A 11/1984 Wallace
4,487,024 A 12/1984 Fletcher et al.
4,550,575 A 11/1985 DeGaynor
4,562,991 A 1/1986 Wu
4,587,810 A 5/1986 Fletcher
4,627,946 A 12/1986 Crabtree
4,669,271 A 6/1987 Noel
4,680,943 A 7/1987 Mawby et al.
4,685,304 A 8/1987 Essig
4,688,386 A 8/1987 Lane et al.
4,727,720 A 3/1988 Wernicki
4,843,827 A 7/1989 Peppers
4,852,359 A 8/1989 Manzotti
4,856,463 A 8/1989 Johnston
4,910,974 A 3/1990 Hara
4,942,742 A 7/1990 Burruel
4,970,877 A 11/1990 Dimijian
4,971,737 A 11/1990 Infanti
5,025,756 A 6/1991 Nyc
D318,281 S 7/1991 McKinlay
5,044,600 A 9/1991 Shannon
5,129,237 A 7/1992 Day et al.
5,157,929 A 10/1992 Hotaling
5,177,980 A 1/1993 Kawamoto et al.
5,196,127 A 3/1993 Solell
5,253,487 A 10/1993 Oike
5,257,601 A 11/1993 Coffin
5,272,888 A 12/1993 Fisher et al.
5,372,492 A 12/1994 Yamauchi
5,378,521 A 1/1995 Ogawa et al.
5,400,605 A 3/1995 Jeong
5,408,844 A 4/1995 Stokes
5,425,243 A 6/1995 Sanuki et al.
5,483,929 A 1/1996 Kuhn et al.
5,586,439 A 12/1996 Schlosser et al.
5,617,728 A 4/1997 Kim et al.
5,632,936 A 5/1997 Su et al.
5,618,463 A 8/1997 Rindler et al.
5,675,975 A 10/1997 Lee
5,761,920 A 6/1998 Wilson et al.
5,768,900 A 6/1998 Lee
5,826,320 A 10/1998 Rathke et al.
5,884,487 A 3/1999 Davis et al.
5,884,490 A 3/1999 Whidden
D415,505 S 10/1999 Myers
5,970,725 A 10/1999 Lee
5,970,735 A 10/1999 Hobelsberger
6,058,720 A 5/2000 Ryu
6,062,036 A 5/2000 Hobelsberger
6,101,817 A 8/2000 Watt
6,145,320 A 11/2000 Kim
6,148,620 A 11/2000 Kumagai et al.
6,148,621 A 11/2000 Byczynski et al.
6,161,390 A 12/2000 Kim
6,179,045 B1 1/2001 Lilleaas
6,209,849 B1 4/2001 Dickmeyer
6,282,909 B1 9/2001 Newman et al.
6,289,683 B1 9/2001 Daukas et al.
6,357,720 B1 3/2002 Shapiro et al.
6,427,463 B1 8/2002 James
6,438,988 B1 8/2002 Paskey
6,467,146 B1 10/2002 Herman
6,481,235 B2 11/2002 Kwon
6,647,739 B1 11/2003 Kim et al.
6,688,130 B1 2/2004 Kim
6,688,131 B1 2/2004 Kim et al.
6,735,959 B1 5/2004 Najewicz
6,742,351 B2 6/2004 Kim et al.
6,763,787 B2 7/2004 Hallenstvedt et al.
6,782,706 B2 8/2004 Holmes et al.
D496,374 S 9/2004 Zimmerman
6,817,200 B2 11/2004 Willamor et al.
6,820,433 B2 11/2004 Hwang
6,857,277 B2 2/2005 Somura
6,935,124 B2 8/2005 Takahashi et al.
6,951,113 B1 10/2005 Adamski
D513,019 S 12/2005 Lion et al.
7,010,934 B2 3/2006 Choi et al.
7,010,937 B2 3/2006 Wilkinson et al.
7,013,654 B2 3/2006 Tremblay et al.
7,051,541 B2 5/2006 Chung et al.
7,059,140 B2 6/2006 Zevlakis
7,062,925 B2 6/2006 Tsuchikawa et al.
7,062,936 B2 6/2006 Rand et al.
7,082,782 B2 8/2006 Schlosser et al.
7,131,280 B2 11/2006 Voglewede et al.

(56) References Cited

U.S. PATENT DOCUMENTS 7,185,508 B2 3/2007 Voglewede et al.
7,188,479 B2 3/2007 Anselmino et al.
7,201,014 B2 4/2007 Hornung
7,204,092 B2 4/2007 Castrellón et al.
7,210,298 B2 5/2007 Lin
7,216,490 B2 5/2007 Joshi
7,216,491 B2 5/2007 Cole et al.
7,234,423 B2 6/2007 Lindsay
7,266,973 B2 9/2007 Anderson et al.
7,297,516 B2 11/2007 Chapman et al.
7,318,323 B2 1/2008 Tatsui et al.
7,386,993 B2 6/2008 Castellón et al.
7,415,833 B2 8/2008 Leaver et al.
7,448,863 B2 11/2008 Yang
7,469,553 B2 12/2008 Wu et al.
7,487,645 B2 2/2009 Sasaki et al.
7,568,359 B2 8/2009 Wetekamp et al.
7,587,905 B2 9/2009 Kopf
7,614,244 B2 11/2009 Venkatakrishnan et al.
7,669,435 B2 3/2010 Joshi
7,681,406 B2 3/2010 Cushman et al.
7,703,292 B2 4/2010 Cook et al.
7,707,847 B2 5/2010 Davis et al.
7,752,859 B2 7/2010 Lee et al.
7,762,092 B2 7/2010 Tikhonov et al.
7,802,457 B2 9/2010 Golovashchenko et al.
7,832,227 B2 11/2010 Wu et al.
7,866,167 B2 1/2011 Kopf
7,918,105 B2 4/2011 Kim
8,015,849 B2 9/2011 Jones et al.
8,037,697 B2 10/2011 LeClear et al.
8,074,464 B2 12/2011 Venkatakrishnan et al.
8,099,989 B2 1/2012 Bradley et al.
8,117,863 B2 2/2012 Van Meter et al.
8,171,744 B2 5/2012 Watson et al.
8,196,427 B2 6/2012 Bae et al.
8,281,613 B2 10/2012 An et al.
8,322,148 B2 12/2012 Kim et al.
8,336,327 B2 12/2012 Cole et al.
8,371,133 B2 2/2013 Kim et al.
8,371,136 B2 2/2013 Venkatakrishnan et al.
8,375,919 B2 2/2013 Cook et al.
8,408,023 B2 4/2013 Shin et al.
8,413,619 B2 4/2013 Cleeves
8,424,334 B2 4/2013 Kang et al.
8,429,926 B2 4/2013 Shaha et al.
8,474,279 B2 7/2013 Besore et al.
8,516,835 B2 8/2013 Holter
8,516,846 B2 8/2013 Lee et al.
8,555,658 B2 10/2013 Kim et al.
8,616,018 B2 12/2013 Jeong et al.
8,646,283 B2 2/2014 Kuratani et al.
8,677,774 B2 3/2014 Yamaguchi et al.
8,746,204 B2 6/2014 Hofbauer
8,756,952 B2 6/2014 Adamski et al.
8,769,981 B2 7/2014 Hong et al.
8,820,108 B2 9/2014 Oh et al.
8,925,335 B2 1/2015 Gooden et al.
8,943,852 B2 2/2015 Lee et al.
9,010,145 B2 4/2015 Lim et al.
9,127,873 B2 9/2015 Tarr et al.
9,140,472 B2 9/2015 Shin et al.
9,217,595 B2 12/2015 Kim et al.
9,217,596 B2 12/2015 Hall
9,476,631 B2 10/2016 Park et al.
2002/0014087 A1 2/2002 Kwon
2003/0111028 A1 6/2003 Hallenstvedt
2004/0099004 A1 5/2004 Somura
2004/0144100 A1 7/2004 Hwang
2004/0206250 A1 10/2004 Kondou et al.
2004/0237566 A1 12/2004 Hwang
2004/0261427 A1 12/2004 Tsuchikawa et al.
2005/0067406 A1 3/2005 Rajarajan et al.
2005/0126185 A1 6/2005 Joshi
2005/0126202 A1 6/2005 Shoukyuu et al.
2005/0151050 A1 7/2005 Godfrey
2005/0160741 A1 7/2005 Park
2005/0160757 A1 7/2005 Choi et al.
2006/0016209 A1 1/2006 Cole et al.
2006/0032262 A1 2/2006 Seo et al.
2006/0053805 A1 3/2006 Flinner et al.
2006/0086107 A1 4/2006 Voglewede et al.
2006/0086134 A1 4/2006 Voglewede et al.
2006/0150645 A1 7/2006 Leaver
2006/0168983 A1 8/2006 Tatsui et al.
2006/0207282 A1 9/2006 Visin et al.
2006/0225457 A1 10/2006 Hallin
2006/0233925 A1 10/2006 Kawamura
2006/0242971 A1 11/2006 Cole et al.
2006/0288726 A1 12/2006 Mod et al.
2007/0028866 A1 2/2007 Lindsay
2007/0107447 A1 5/2007 Langlotz
2007/0119202 A1 5/2007 Kadowaki et al.
2007/0130983 A1 6/2007 Broadbent et al.
2007/0137241 A1 6/2007 Lee et al.
2007/0193278 A1 8/2007 Polacek et al.
2007/0227162 A1 10/2007 Wang
2007/0227164 A1 10/2007 Ito et al.
2007/0262230 A1 11/2007 McDermott
2008/0034780 A1* 2/2008 Lim ..... F25C 1/04 62/353
2008/0104991 A1 5/2008 Hoehne et al.
2008/0145631 A1 6/2008 Bhate et al.
2008/0236187 A1 10/2008 Kim
2008/0264082 A1 10/2008 Tikhonov et al.
2008/0289355 A1 11/2008 Kang et al.
2009/0049858 A1 2/2009 Lee et al.
2009/0120306 A1 5/2009 DeCarlo et al.
2009/0165492 A1 7/2009 Wilson et al.
2009/0173089 A1 7/2009 LeClear et al.
2009/0178430 A1 7/2009 Jendrusch et al.
2009/0187280 A1 7/2009 Hsu et al.
2009/0199569 A1 8/2009 Petrenko
2009/0211266 A1 8/2009 Kim et al.
2009/0211271 A1 8/2009 Kim et al.
2009/0223230 A1 9/2009 Kim et al.
2009/0235674 A1 9/2009 Kern et al.
2009/0272259 A1 11/2009 Cook et al.
2009/0308085 A1 12/2009 DeVos
2010/0011827 A1 1/2010 Stoeger et al.
2010/0018226 A1 1/2010 Kim et al.
2010/0031675 A1 2/2010 Kim et al.
2010/0043455 A1 2/2010 Kuehl et al.
2010/0050663 A1 3/2010 Venkatakrishnan et al.
2010/0050680 A1 3/2010 Venkatakrishnan et al.
2010/0055223 A1 3/2010 Kondou et al.
2010/0095692 A1 4/2010 Jendrusch et al.
2010/0101254 A1 4/2010 Besore et al.
2010/0126185 A1 5/2010 Cho et al.
2010/0139295 A1 6/2010 Zuccolo et al.
2010/0163707 A1 7/2010 Kim
2010/0180608 A1 7/2010 Shaha et al.
2010/0197849 A1 8/2010 Momose et al.
2010/0218518 A1 9/2010 Ducharme et al.
2010/0218540 A1 9/2010 McCollough et al.
2010/0218542 A1 9/2010 McCollough et al.
2010/0251730 A1 10/2010 Whillock, Sr.
2010/0257888 A1 10/2010 Kang et al.
2010/0293969 A1 11/2010 Braithwaite et al.
2010/0313594 A1 12/2010 Lee et al.
2010/0319367 A1 12/2010 Kim et al.
2010/0326093 A1 12/2010 Watson et al.
2011/0005263 A1 1/2011 Yamaguchi et al.
2011/0023502 A1 2/2011 Ito et al.
2011/0062308 A1 3/2011 Hammond et al.
2011/0146312 A1 6/2011 Hong et al.
2011/0192175 A1 8/2011 Kuratani et al.
2011/0214447 A1 9/2011 Bortoletto et al.
2011/0239686 A1 10/2011 Zhang et al.
2011/0265498 A1 11/2011 Hall
2012/0007264 A1 1/2012 Kondou et al.
2012/0011868 A1 1/2012 Kim et al.
2012/0023996 A1 2/2012 Herrera et al.
2012/0047918 A1 3/2012 Herrera et al.

(56) References Cited

U.S. PATENT DOCUMENTS

| | | | | |
|---|---|---|---|---|
| 2012/0073538 | A1 | 3/2012 | Hofbauer | |
| 2012/0085302 | A1 | 4/2012 | Cleeves | |
| 2012/0174613 | A1 | 7/2012 | Park et al. | |
| 2012/0240613 | A1 | 9/2012 | Saito et al. | |
| 2012/0291473 | A1 | 11/2012 | Krause et al. | |
| 2016/0370078 | A1 | 12/2016 | Koo | |
| 2017/0074527 | A1 | 3/2017 | Visin | |
| 2017/0191722 | A1 | 7/2017 | Bertolini et al. | |
| 2017/0241694 | A1 | 8/2017 | Ji et al. | |
| 2017/0307281 | A1 | 10/2017 | Morgan et al. | |
| 2017/0314841 | A1* | 11/2017 | Koo | F25D 11/02 |
| 2018/0017306 | A1 | 1/2018 | Miller | |
| 2018/0100681 | A1* | 4/2018 | Laible | F25C 5/22 |

FOREIGN PATENT DOCUMENTS

| | | | |
|---|---|---|---|
| CN | 102353193 | A | 9/2011 |
| DE | 202006012499 | U1 | 10/2006 |
| DE | 102008042910 | A1 | 4/2010 |
| DE | 102009046030 | | 4/2011 |
| EP | 1653171 | | 5/2006 |
| EP | 1821051 | A1 | 8/2007 |
| EP | 2078907 | A2 | 7/2009 |
| EP | 2375200 | A1 | 10/2011 |
| EP | 2444761 | A2 | 4/2012 |
| EP | 2660541 | | 11/2013 |
| EP | 2743608 | A2 | 6/2014 |
| EP | 3106795 | A1 | 12/2016 |
| EP | 3239629 | A1 | 11/2017 |
| FR | 2771159 | A1 | 5/1999 |
| GB | 657353 | A | 9/1951 |
| GB | 2139337 | A | 11/1984 |
| JP | S49111267 | U | 9/1974 |
| JP | S49111268 | U | 9/1974 |
| JP | S5490747 | U | 6/1979 |
| JP | S5640368 | U | 4/1981 |
| JP | S60141239 | A | 7/1985 |
| JP | S6171877 | U | 5/1986 |
| JP | 6435375 | | 3/1989 |
| JP | H01196478 | A | 8/1989 |
| JP | H01210778 | A | 8/1989 |
| JP | H01310277 | A | 12/1989 |
| JP | H024185 | A | 1/1990 |
| JP | H0231649 | A | 2/1990 |
| JP | H02143070 | A | 6/1990 |
| JP | H0370965 | A | 3/1991 |
| JP | H03158670 | A | 7/1991 |
| JP | H03158673 | A | 7/1991 |
| JP | H0415069 | A | 1/1992 |
| JP | H04161774 | A | 6/1992 |
| JP | H4260764 | A | 9/1992 |
| JP | H051870 | A | 1/1993 |
| JP | H05248746 | A | 9/1993 |
| JP | H05332562 | A | 12/1993 |
| JP | H063005 | A | 1/1994 |
| JP | H0611219 | A | 1/1994 |
| JP | H06323704 | A | 11/1994 |
| JP | H10227547 | A | 8/1998 |
| JP | H10253212 | A | 9/1998 |
| JP | H11223434 | A | 8/1999 |
| JP | 2000039240 | A | 2/2000 |
| JP | 2000346506 | A | 12/2000 |
| JP | 2001041620 | A | 2/2001 |
| JP | 2001041624 | A | 2/2001 |
| JP | 2001221545 | A | 8/2001 |
| JP | 2001355946 | | 12/2001 |
| JP | 2002139268 | A | 5/2002 |
| JP | 2002295934 | A | 10/2002 |
| JP | 2002350019 | A | 12/2002 |
| JP | 2003042612 | A | 2/2003 |
| JP | 2003042621 | A | 2/2003 |
| JP | 2003172564 | A | 6/2003 |
| JP | 2003232587 | A | 8/2003 |
| JP | 2003269830 | A | 9/2003 |
| JP | 2003279214 | A | 10/2003 |
| JP | 2003336947 | A | 11/2003 |
| JP | 2004053036 | A | 2/2004 |
| JP | 2004278894 | A | 10/2004 |
| JP | 2004278990 | A | 10/2004 |
| JP | 2005164145 | A | 6/2005 |
| JP | 2005180825 | A | 7/2005 |
| JP | 2005195315 | A | 7/2005 |
| JP | 2006022980 | A | 1/2006 |
| JP | 2006071247 | A | 3/2006 |
| JP | 2006323704 | A | 11/2006 |
| JP | 2007232336 | A | 9/2007 |
| JP | 4333202 | B2 | 9/2009 |
| KR | 20010109256 | A | 12/2001 |
| KR | 20060013721 | A | 2/2006 |
| KR | 20060126156 | A | 12/2006 |
| KR | 100845860 | B1 | 7/2008 |
| KR | 20100123089 | A | 11/2010 |
| KR | 20110037609 | A | 4/2011 |
| RU | 2365832 | C2 | 8/2009 |
| SU | 1747821 | A1 | 7/1992 |
| TW | 424878 | U | 3/2001 |
| WO | 8808946 | A1 | 11/1988 |
| WO | 2008052736 | A1 | 5/2008 |
| WO | 2008056957 | A2 | 5/2008 |
| WO | 2008061179 | A2 | 5/2008 |
| WO | 2008143451 | A1 | 11/2008 |
| WO | 2012025369 | A3 | 3/2012 |

* cited by examiner

ICE-MAKING APPLIANCE

BACKGROUND

Ice-making assemblies are commonly disposed within refrigerated appliances. It is therefore desired to develop ice-making appliances and assemblies for creating equalized airflow within the ice-making appliance for ensuring even ice formation.

BRIEF SUMMARY OF THE INVENTION

In at least one aspect, an icemaker for a refrigerated appliance is provided herein. The icemaker includes an ice tray having a plurality of ice-forming compartments. A duct system has upper and lower baffles. The upper baffle directs chilled air above the ice tray and the lower baffle directs chilled air below the ice tray. A deflector is operably coupled with the upper baffle. The deflector has a transition portion offset from a body portion. A diverter is disposed between the deflector and the ice tray. The diverter defines a plurality of variously sized slots therein.

In at least another aspect, an icemaker for a refrigerated appliance is provided herein. The icemaker includes an ice tray having a plurality of ice-forming compartments. A duct system has upper and lower baffles. The upper baffle directs chilled air above the ice tray and the lower baffle directs chilled air below the ice tray. A deflector is operably coupled with the upper baffle. The deflector has a transition portion offset from a body portion. A diverter is disposed between the deflector and the ice tray.

In yet another aspect, an icemaker for a refrigerated appliance is provided herein. The icemaker includes an ice tray having a plurality of ice-forming compartments. A duct system has upper and lower baffles. The upper baffle directs chilled air above the ice tray and the lower baffle directs chilled air below the ice tray. A diverter defines a plurality of variously sized slots therein disposed above the ice tray.

These and other features, advantages, and objects of the present device will be further understood and appreciated by those skilled in the art upon studying the following specification, claims, and appended drawings.

DETAILED DESCRIPTION

Figure 1:
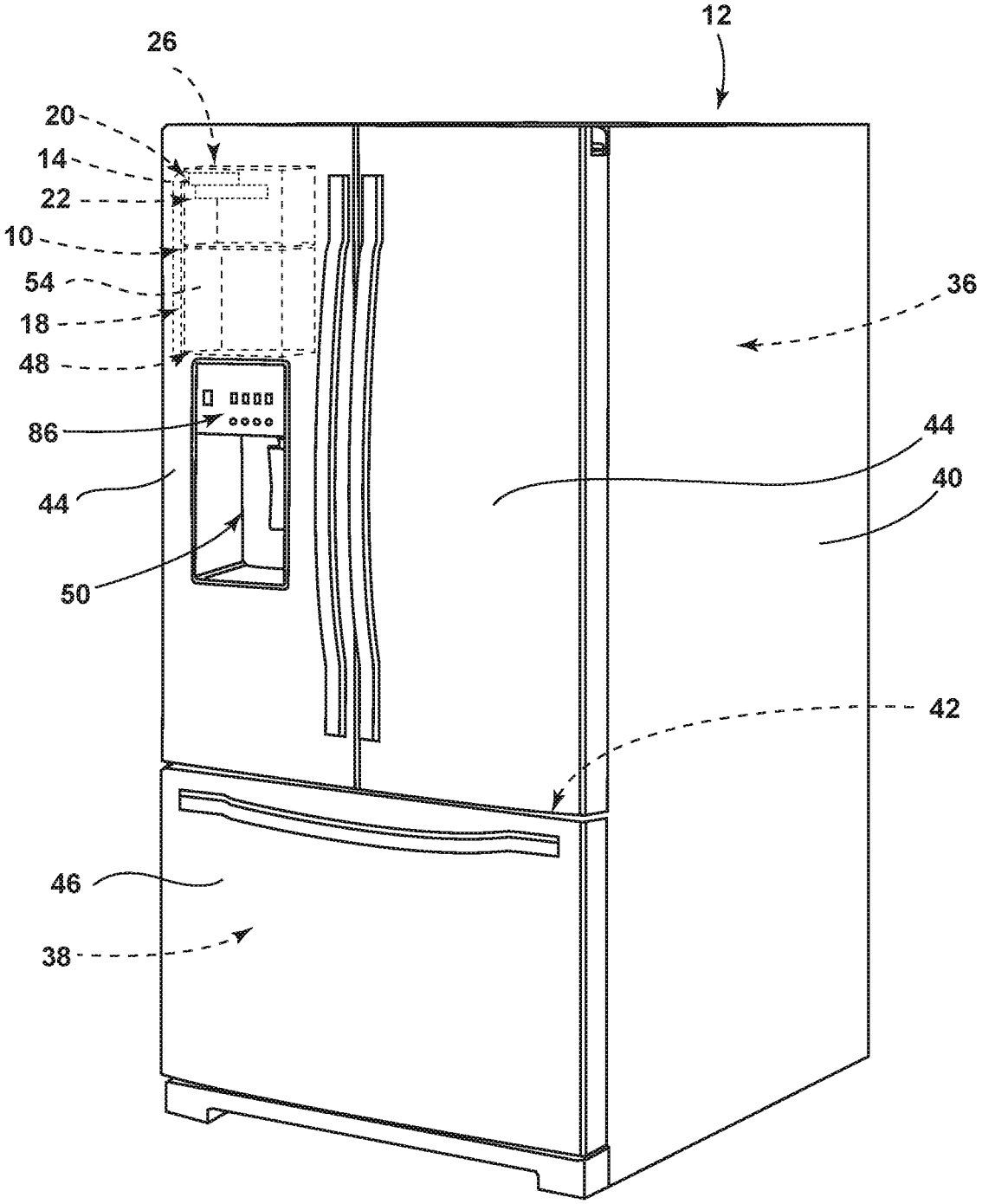
FIG. 1 is a front perspective view of a refrigerated appliance incorporating an icemaker.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary examples of the inventive concepts defined in the appended claims. Hence, specific dimensions and other physical characteristics relating to the examples disclosed herein are not to be considered as limiting, unless the claims expressly state otherwise.

As required, detailed examples of the present invention are disclosed herein. However, it is to be understood that the disclosed examples are merely exemplary of the invention that may be embodied in various and alternative forms. The figures are not necessarily to a detailed design and some schematics may be exaggerated or minimized to show function overview. Therefore, specific structural and functional details disclosed herein are not to be interpreted as limiting, but merely as a representative basis for teaching one skilled in the art to variously employ the present invention.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

With reference to FIGS. 1-10, an icemaker 10 for a refrigerated appliance 12 is provided herein. The icemaker 10 includes an ice tray 14 having a plurality of ice-forming compartments 16. A duct system 18 has upper and lower baffles 20, 22. The upper baffle 20 directs chilled air 24 above the ice tray 14 and the lower baffle 22 directs the chilled air 24 below the ice tray 14. A deflector 26 is operably coupled with the upper baffle 20. The deflector 26 has a transition portion 28 offset from a body portion 30. A diverter 32 is disposed between the deflector 26 and the ice tray 14. The deflector 26 defines a plurality of variously sized slots 34 therein.

Figure 2:
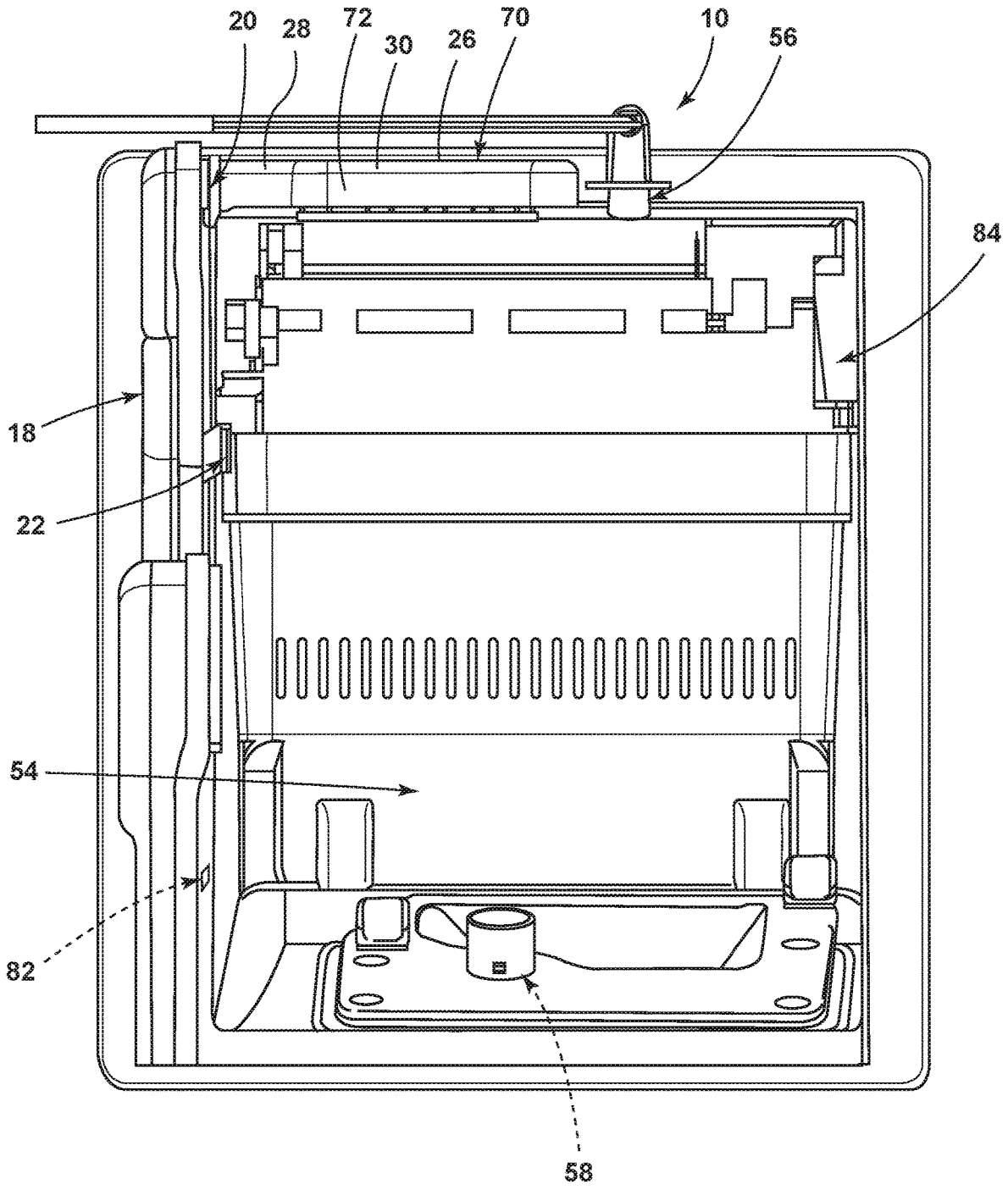
FIG. 2 is a side perspective view of an icemaker for a refrigerated appliance incorporating an upper baffle and a lower baffle, according to some examples.

Referring to FIGS. 1 and 2, reference numeral 10 generally designates the refrigerated appliance 12 with the icemaker 10. The icemaker may be used as a stand-alone appliance or within another appliance, such as a refrigerator. The ice-making process may be induced, carried out, stopped, and the ice is harvested with little, or no, user input. FIG. 1 generally shows a refrigerator of the French-door bottom mount type, but it is understood that this disclosure could apply to any type of refrigerator, such as a side-by-side, two-door bottom mount, or a top-mount type refrigeration unit.

As shown in FIGS. 1 and 2, the refrigerated appliance 12 may have a refrigerated compartment 36 configured to refrigerate consumables and a freezer compartment 38 configured to freeze consumables during normal use. Accordingly, the refrigerated compartment 36 may be kept at a temperature above the freezing point of water and generally below a temperature of from about 35° F. to about 50° F., more typically below about 38° F. and the freezer compartment 38 may be kept at a temperature below the freezing point of water.

In some instances, the refrigerated appliance 12 has a cabinet 40 and a liner within the cabinet 40 to define the refrigerated compartment 36 and the freezer compartment 38. A mullion 42 may separate the refrigerated compartment 36 and the freezer compartment 38.

The refrigerated appliance 12 may have one or more doors 44, 46 that provide selective access to the interior volume of the refrigerated appliance 12 where consumables may be stored. As shown, the refrigerated compartment doors are designated 44, and the freezer door is designated 46. It is appreciated that the refrigerated compartment 36 may only have one door 44.

The icemaker 10 may be positioned within the door 44 and in an icemaker receiving space 48 of the appliance to allow for delivery of ice through the door 44 in a dispensing area 50 on the exterior of the appliance. The dispensing area 50 may be at a location on the exterior below the level of an ice storage bin 54 to allow gravity to force the ice down an ice dispensing chute in the refrigerated appliance door 44. The chute extends from the storage bin 54 to the dispenser area 50 and ice may be pushed into the chute using an electrically power-driven auger 58.

The refrigerated appliance 12 may also have a water inlet that is fastened to and in fluid communication with a household supply of potable water. The water inlet may be fluidly engaged with one or more of a water filter, a water reservoir, and a refrigerated appliance water supply line. The water supply line may include one or more nozzles and one or more valves. The water supply line may supply water to one or more water outlets 56. For example, a first outlet may dispense water in the dispensing area and a second outlet 56 may dispense water into the ice tray 14. The refrigerated appliance 12 may also have a control board or controller that sends electrical signals to the one or more valves when prompted by a user through a user interface 86, which may be on the front face of a door 44, that water is desired or if an ice-making cycle is to begin.

The icemaker 10 may be located at an upper portion of the icemaker receiving space 48. The ice storage bin 54 may be located below the icemaker 10 such that as ice is harvested, the icemaker 10 uses gravity to transfer the ice from the icemaker 10 to the ice storage bin 54.

Figure 3:
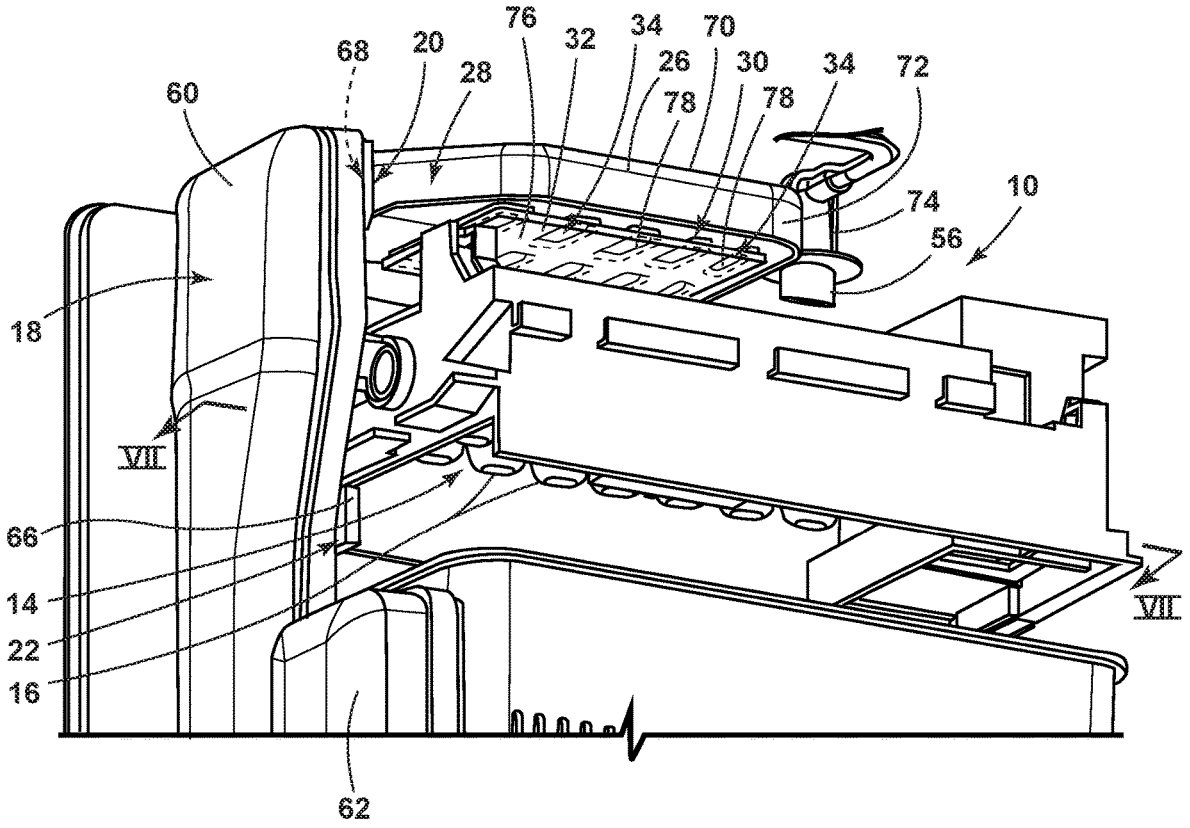
FIG. 3 is a bottom perspective view of the icemaker, according to some examples.
Figure 4:
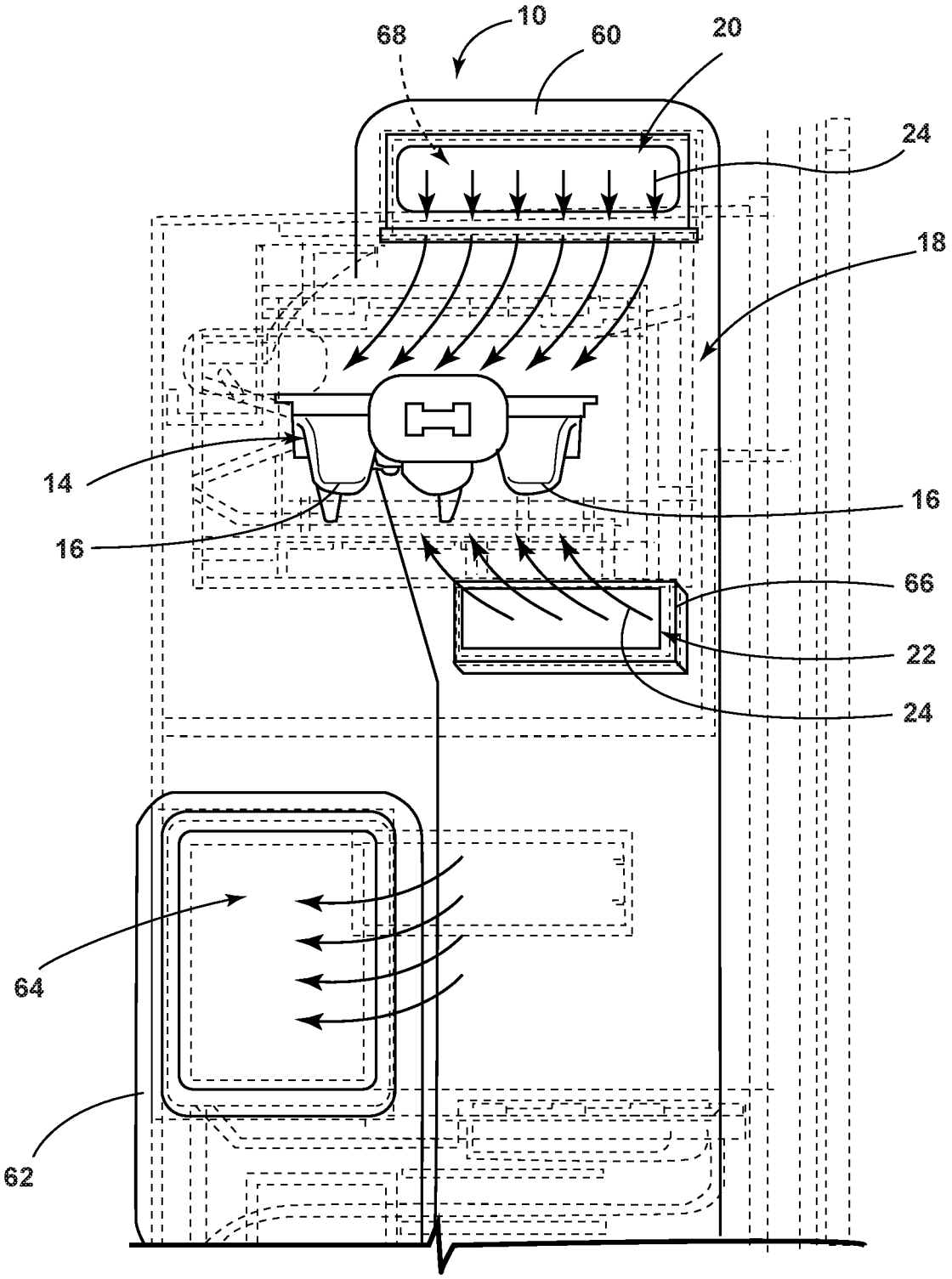
FIG. 4 is a side plan view of a duct system that supplies chilled air for the icemaker and an ice tray disposed between the upper baffle and the lower baffle, according to some examples.

As shown in FIGS. 3 and 4, the refrigerated appliance 12 may also have one or more ducts that form the duct system 18. In some examples, the duct system 18 may include a supply duct 60 and a return duct 62. The supply duct 60 may be disposed in close proximity to the ice tray 14 to direct chilled air 24 at the tray and water disposed within the tray. The return duct 62 may be disposed in close proximity to the ice bin. Accordingly, the chilled air 24 may be directed toward the ice tray 14, circulated through the ice bin, and exit through a return vent 64 defined by the return duct 62. In some examples, the return vent 64 is proximate the ice bin.

In some examples, the supply duct 60 includes the upper baffle 20 and the lower baffle 22. The upper baffle 20 is disposed above the ice tray 14 and may direct the chilled air 24 in a downward and/or horizontal direction. The lower baffle 22 may include an upwardly directed rim section 66 that is configured to direct the chilled air 24 at a bottom side of the ice tray 14. Accordingly, chilled air 24 may be directed at two opposing sides of the ice tray 14, which may decrease the amount of time needed to freeze water in the trays during the ice-making process. In some examples, the rim section 66 may be an additional component that is operably coupled to the lower baffle 22. Alternatively, the rim section 66 may be integrally formed with the lower baffle 22 and/or the supply duct 60. Moreover, in some instances, the rim section 66 is configured to direct the chilled air 24 at the bottom side of the ice tray 14 with no obstacles between the rim section 66 and the ice tray 14.

The deflector 26 is operably coupled with the upper baffle 20 and is configured to redirect air from the upper baffle 20 towards various portions of the ice tray 14. Accordingly, the deflector 26 includes an entry portion 68 that is proximate the upper baffle 20. The deflector 26 further includes a top surface 70 and a peripheral portion 72 extending therefrom. As the chilled air 24 is directed outwardly from the upper baffle 20, the chilled air 24 is substantially maintained below the deflector 26. Moreover, the deflector 26 is configured to direct the chilled air 24 downwardly and towards the ice tray 14.

In some examples, the deflector 26 may be disposed over a portion of the ice tray 14. Or, in other words, the second water supply outlet 56 is disposed over the ice tray 14 on an opposing side of the deflector 26 from the upper baffle 20. A heater 74 is installed on the second water supply outlet 56. The heater 74 heats the outlet to prevent blockages thereof. The heater 74 may include an electric heating medium that generates heat upon receiving electric power or the like. The heater 74 heats the bottom portion of the outlet 56 before the water supply is operated so that the water can be easily disposed within the ice tray 14.

Figure 5A:
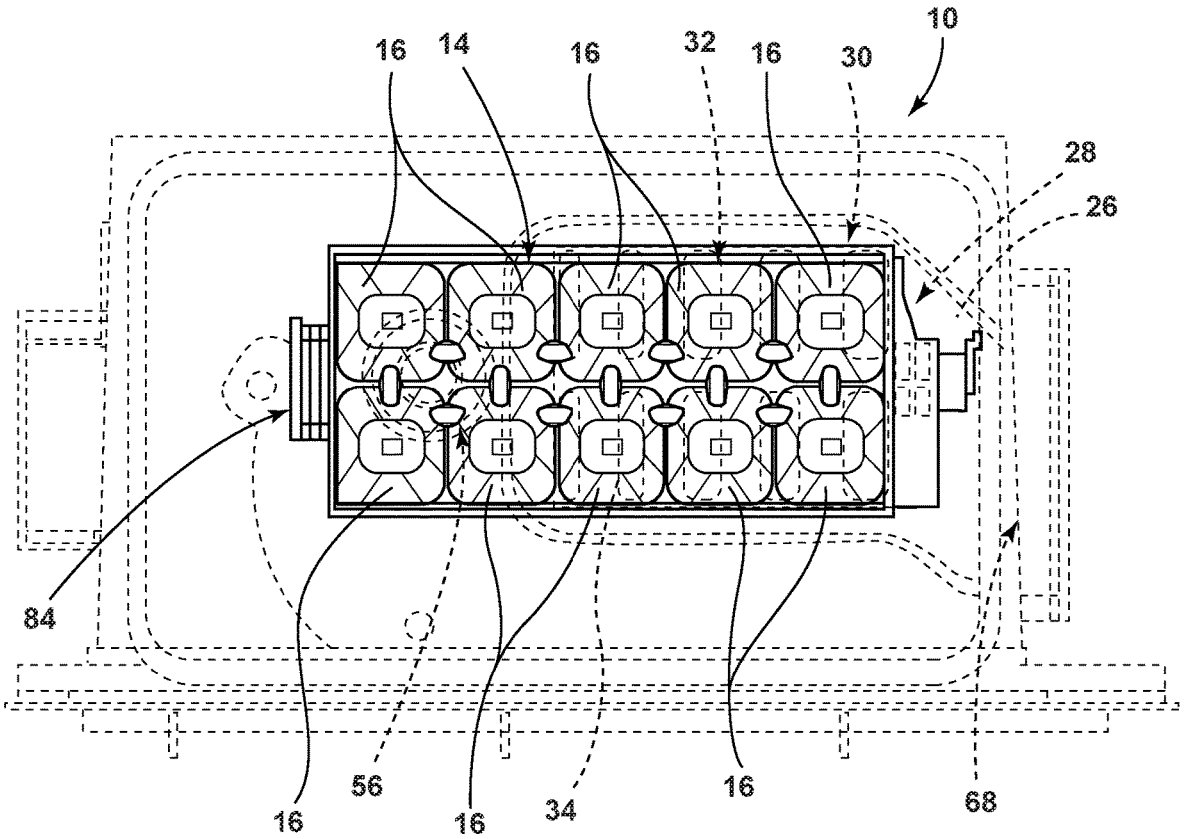
FIG. 5A is a top plan view of the ice tray, according to some examples.
Figure 5B:
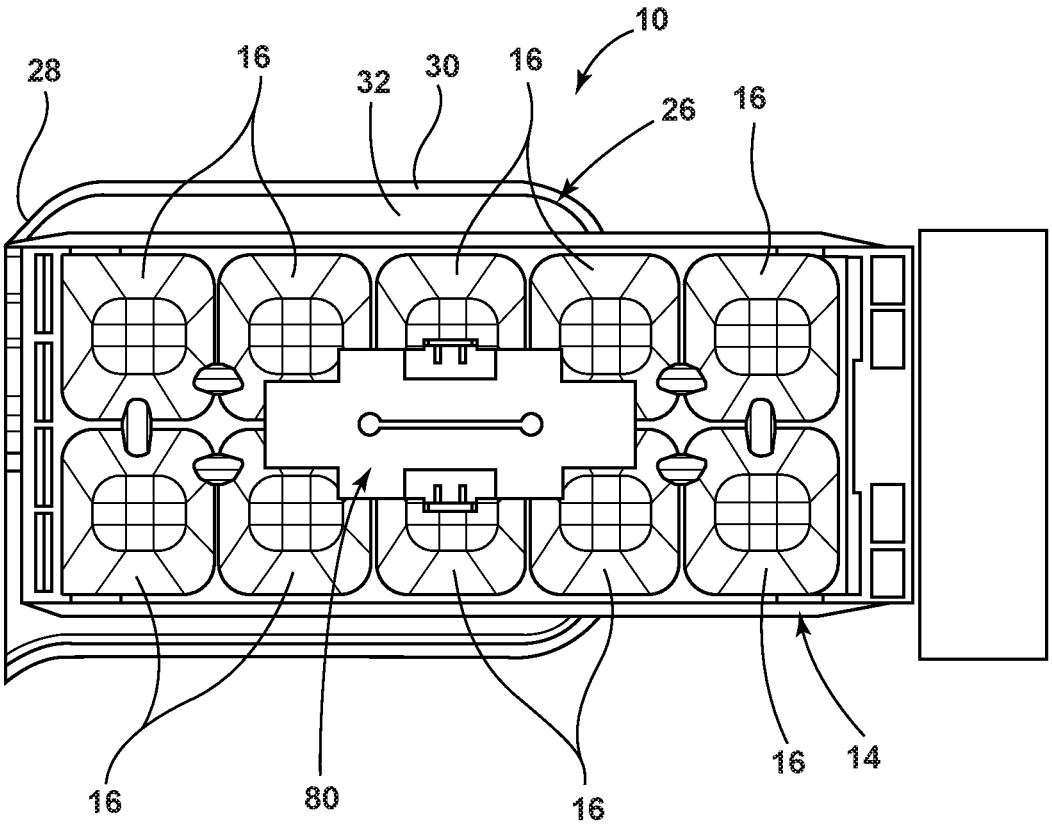
FIG. 5B is a bottom plan view of the ice tray, according to some examples.
Figure 6:
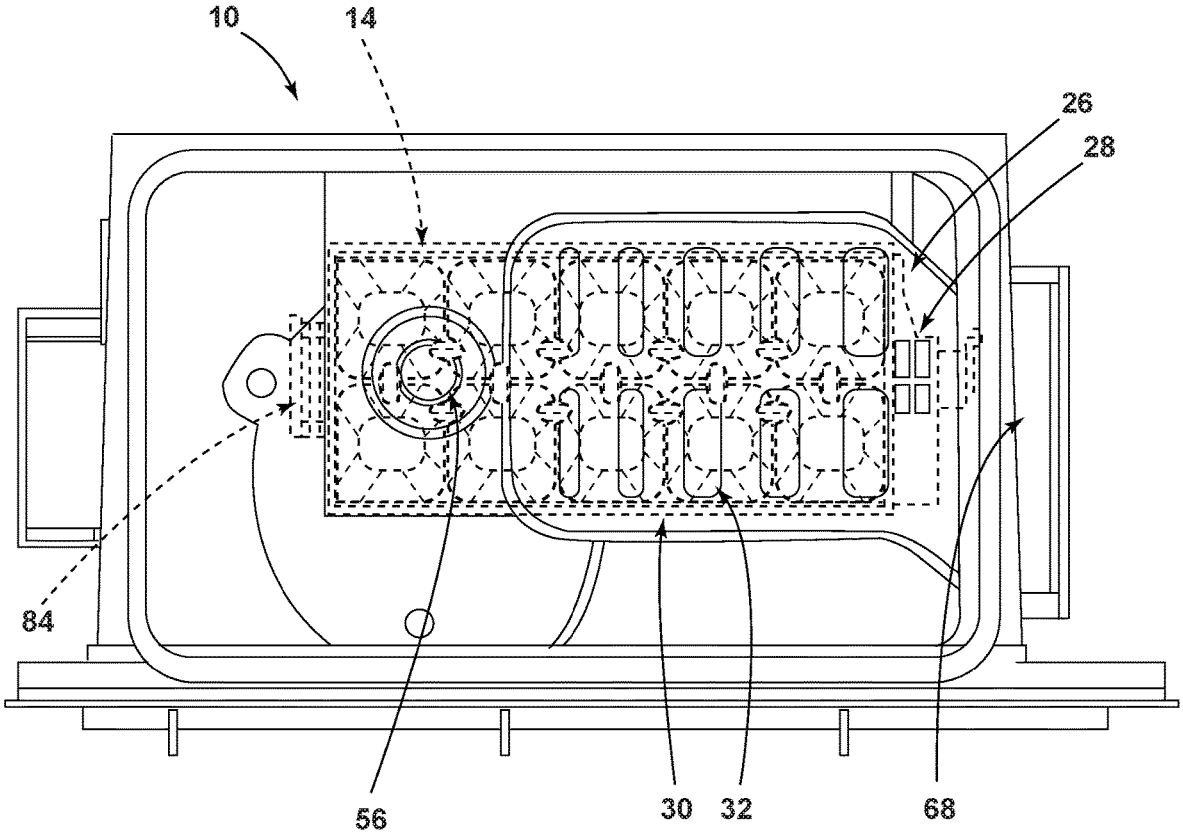
FIG. 6 is a top plan view of the deflector, according to some examples.
Figure 7:
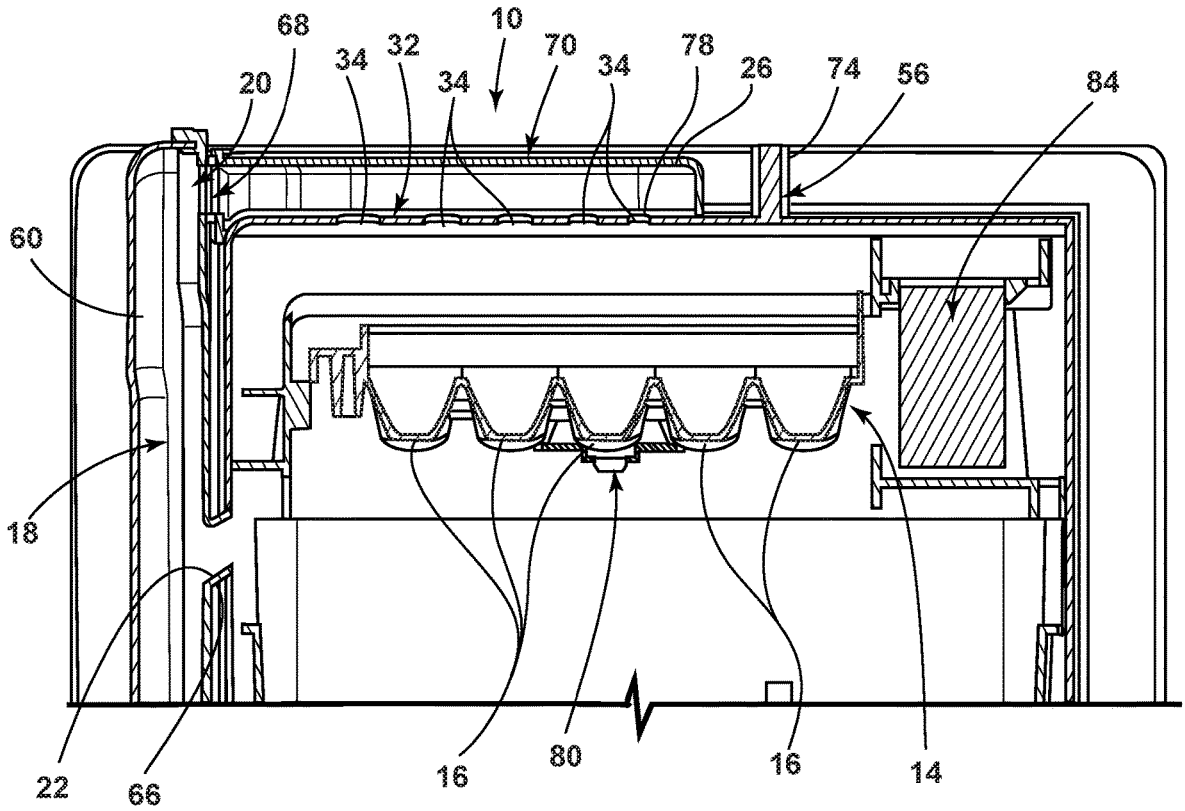
FIG. 7 is a cross-sectional view taken along the line VII-VII of FIG. 3 illustrating the icemaker according to some examples.
Figure 8:
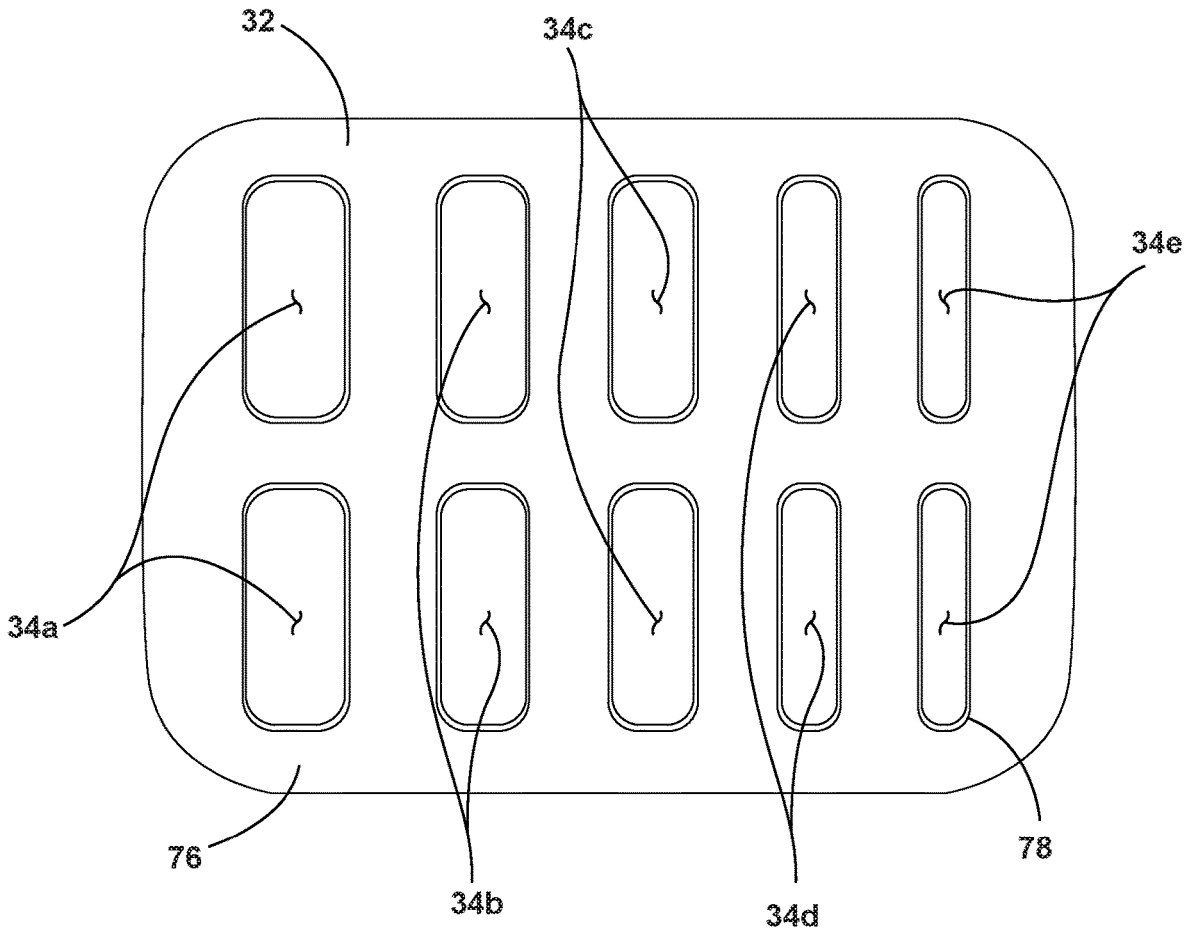
FIG. 8 is a top plan view of the diverter defining variously sized slots therealong, according to some examples.

Referring to FIGS. 5A-6, the upper and lower baffles 20, 22 may be offset from the ice tray 14. Accordingly, the deflector 26 may have a transition portion 28 that directs air from the upper baffle 20 to the body portion 30 over the ice tray 14. The body portion 30 may be operably coupled with an air diverter 32 that directs the chilled air 24 within the body portion 30 through predefined slots 34 within the diverter 32.

Referring to FIGS. 3-7, the diverter 32 may include a base 76 that defines the plurality of slots 34. A border 78 may surround each of the plurality of slots 34. In some instances, the border 78 extends upwardly from the base 76 and encompasses each respective slot. Each slot defines an opening area through which the chilled air 24 is directed. In some examples, a first pair of slots **34*a* (FIG. 8) closest to the upper baffle 20 has a first opening area. An adjacently disposed second pair of slots 34***b* on an opposing side of the first pair of slots 34*a* from the upper baffle 20 has a second opening area that is smaller than the first opening area. Likewise, a third pair of slots 34*c* is disposed on opposing side of the second pair of slots 34*b* from the first pair of slots 34*a* and has a third opening area that is less than the second opening area. A fourth pair of slots 34*d* defines a fourth opening area and has a smaller opening area than the third area. Lastly, a fifth pair of slots 34*e* defines a fifth opening area that is less than the fourth area. It will be appreciated, however, that any of the slots 34*a*, 34*b*, 34*c*, 34*d*, 34*e* may have an opening area that is equal to any number, or all, of the remaining slots. Moreover, the slots 34*a*, 34*b*, 34*c*, 34*d*, 34*e* may be varied in any other pattern without departing from the scope of the present disclosure. Furthermore, in some instances, any and/or all of the slots 4*a*, 34*b*, 34*c*, 34*d*, 34*e* disposed on the diverter 32 may be of an equal size to one another without departing from the scope of the present disclosure.

In some instances, the fifth pair of slots 34*e* has a smaller opening area such that the chilled air 24 is directed therethrough at a higher pressure and/or velocity than the first pair of slots 34*a*. For example, the airflow velocity can be calculated by the following formula: air velocity=air flow/area of the duct. Accordingly, as the size of the slot is decreased, the airflow velocity is increased. The airflow may be increased to reach portions of the tray that extend beyond the diverter 32. Additionally, and/or alternatively, the airflow may be increased to decrease the amount of time before the chilled air 24 reaches the ice tray 14 to increase the efficiency of the water freezing process.

As illustrated in FIGS. 5A-6, the air diverter 32 may be disposed over a portion of the ice tray 14. However, it will be appreciated that in other examples the diverter 32 may be disposed over the whole ice tray 14 without departing from the teachings provided herein. As illustrated, the ice tray 14 includes five longitudinally aligned compartments 16 in which ice may be formed and the diverter 32 extends over four of the five longitudinally aligned compartments 16. As the chilled air 24 is directed from the upper baffle 20 and through the deflector 26 and the slots 34 in the diverter 32, the chilled air 24 is forced away from the duct system 18 causing a first end portion of the ice tray 14 that is proximate the duct system 18 and a second end portion of the ice tray 14 on an opposing side of the ice tray 14 to be contacted by the chilled air 24.

In some examples, the ice tray 14 may incorporate a temperature sensor 80, for example, a thermistor or other temperature-sensing element positioned beneath the ice tray 14 in close proximity to the compartments 16 so as to sense a temperature of that volume. Temperatures above the freezing point generally indicate incomplete freezing of the cubes, whereas temperatures below freezing indicate that the cube has frozen and no additional phase change is occurring. As provided herein, the first end portion of the ice tray 14 may be proximate the duct system 18 while the second end portion of the ice tray 14 may be disposed further from the duct system 18. The temperature sensor 80 may be disposed outwardly of a portion of the ice tray 14 that is directly contacted by the chilled air as a temperature of the non-directly contacted portions of the ice tray. It will be appreciated, however, that the temperature sensor may be disposed in any practicable location without departing from the scope of the present disclosure.

In operation, the icemaker 10 may begin an ice-making cycle when a controller in electrical communication with an ice level sensor 82 (FIG. 2), ice level input measuring system and/or device detects an actual ice level is below a predetermined ice level. To begin the ice-making process, the icemaker 10 checks whether the ice tray 14 is in the home position, such as an upright or horizontal position. If the ice tray 14 is not in its home position, the controller may send a signal to a motor 84 to rotate the ice tray 14 back to its home position. Once the ice tray 14 is determined to be in its home position, the controller determines whether any previous harvests were completed. If the previous harvest was completed, the controller may send an electrical signal to open a valve in fluid communication with the icemaker 10. Either after a predetermined amount of valve open time or when the controller senses that a predetermined amount of water has been delivered to the ice tray 14, a signal will be sent by the controller to the valve to close the valve. The predetermined amount of water may be based on the size of the ice tray 14 and/or the speed at which a user would like ice and may be set at the point of manufacture or based on an input from a user into a user interface 86 (FIG. 1). The water outlet 56 may be positioned above the ice tray 14, such that the water falls with the force of gravity into the ice tray 14.

After the ice tray 14 is filled, or if the controller determines that the previous harvest was incomplete, the freeze timer may be started, and the chilled air 24 at a temperature below the freezing point of water is forced through the supply duct 60 of the duct system 18 of the icemaker. The air may be forced by one or more fan or any other method of moving air known in the art. As provided herein, the duct system 18 includes an upper baffle 20 that directs air from the duct system 18 above the ice tray 14 and a lower baffle 22 that directs air at a bottom side of the ice tray 14.

During the freezing process, the controller may determine if a refrigerated appliance door 44 has been opened. If the door 44 is determined to be open at any time, the freeze timer is paused until the door 44 is closed. After some time, substantially all or all of the water will be frozen into ice. The controller may detect this by using the thermistor or another sensor. During the freezing process, the controller also may determine if the temperature of the ice tray 14 or the temperature within the ice compartment 16 is above a certain temperature for a certain amount of time. This temperature may be between 20° F. and 30° F., and more typically from about 22° F. to about 28° F. If the controller determines that the temperature was above the specified temperature for longer than the specified time, the freeze timer may reset.

When the freeze timer reaches a predetermined time and/or when the thermistor sends an electrical signal to the controller that a predetermined temperature of the ice tray 14 is met, the controller may read this as the water is frozen, and it may begin the harvesting process. Consequently, the controller will send a signal to the motor 84 to begin rotating. As the motor 84 begins rotating, the ice tray 14, which is rotationally engaged with the motor 84 at the second end portion, rotates with it. The ice tray 14 may begin at a substantially horizontal position. The motor 84 rotates the ice tray 14 to a predetermined angle. When the motor 84 and tray reach the predetermined angle, the first end portion of the ice tray 14 may be prevented from rotating any further by a bracket stop. With the first end portion held in place by the bracket stop, the motor 84 continues to rotate the ice tray 14 to a second predetermined angle. By continuing to rotate the second end portion, a twist is induced in the ice tray 14. The twist in the ice tray 14 induces an internal stress between the ice and the ice tray 14, which separates the ice from the ice tray 14. The twist angle may be any angle sufficient to break the ice loose from the ice tray 14. After the rotation is complete, the motor 84 returns to its home position. If the controller determines that the ice tray 14 reached the harvest position and back to home position, the cycle may begin again.

Figure 9:
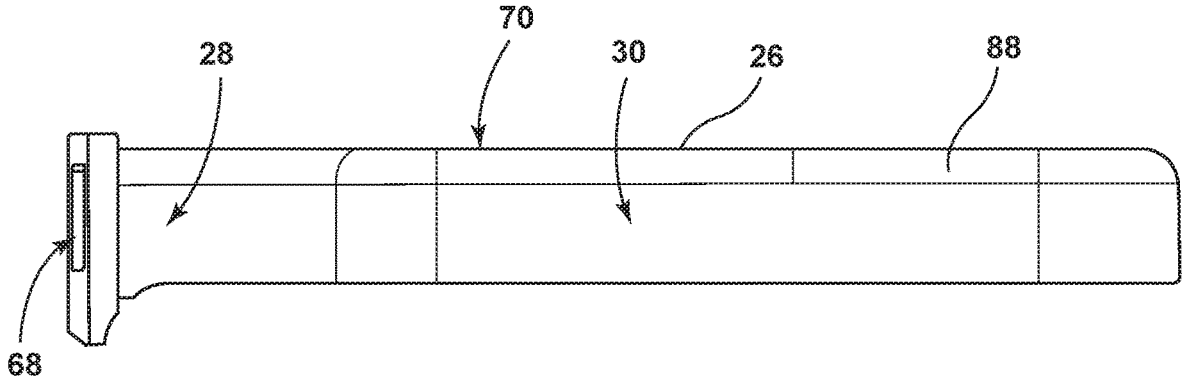
FIG. 9 is a side plan view of the deflector according to some examples.
Figure 10:
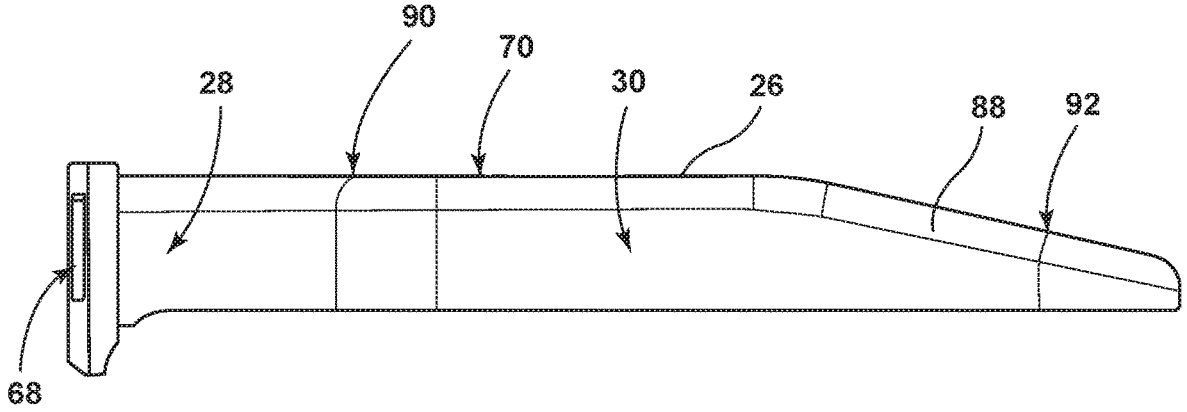
FIG. 10 is a side plan view of the deflector according to some examples.

Referring to FIGS. 9 and 10, as provided herein, the deflector 26 includes the body portion 30 and the transition portion 28. In some examples, the deflector 26 may be integrally formed with a portion of the duct system 18. The body portion 30 is disposed over the ice tray 14 while the transition portion 28 may be offset from the body portion 30 and configured to couple to the duct system 18 around the upper baffle 20. The entry portion 68 of the deflector 26 may surround the upper baffle 20. In other examples, the entry portion 68 may partially surround or otherwise be operably coupled with the upper baffle 20.

With further reference to FIGS. 9 and 10, the body portion 30 of the deflector 26 may be of any practicable geometry without departing from the scope of the present disclosure. For example, as illustrated in FIG. 9, the body portion 30 of the deflector 26 may have a linear top surface 70. A radiused portion 88 may couple the body portion 30 to the peripheral portion 72. Alternatively, as illustrated in FIG. 10, the top surface 70 of the body portion 30 may have a first linear section 90 and a second section 92 that is angled downwardly from the first section 90. Like the example illustrated in FIG. 9, the radiused portion 88 couples the top surface 70 to the peripheral portion 72.

A variety of advantages may be derived from the use of the present disclosure. For example, use of the icemaker provided herein may decrease the freezing time for making ice within a refrigerated appliance. The use of the deflector provided herein may assist in directing chilled air towards the ice tray to further assist in the ice-making process. Furthermore, a diverter may be used in conjunction with the deflector for directing air in desired locations at various pressures based on the slot sizing disposed within the diverter. The ice-making assembly provided herein may be more efficient and/or cheaper to manufacture than ice-making systems currently available.

It will be understood by one having ordinary skill in the art that construction of the described invention and other components is not limited to any specific material. Other exemplary examples of the invention disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

Furthermore, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected" or "operably coupled" to each other to achieve the desired functionality, and any two components capable of being so associated can also be viewed as being "operably coupleable" to each other to achieve the desired functionality. Some examples of operably coupleable include, but are not limited to, physically mateable and/or physically interacting components and/or wirelessly interactable and/or wirelessly interacting components and/or logically interacting and/or logically interactable components. Furthermore, it will be understood that a component preceding the term "of the" may be disposed at any practicable location (e.g., on, within, and/or externally disposed from the appliance) such that the component may function in any manner described herein.

It is also important to note that the construction and arrangement of the elements of the invention as shown in the exemplary examples is illustrative only. Although only a few examples of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system might be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary examples without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

What is claimed is:

1. An icemaker for a refrigerated appliance, the icemaker comprising:

an ice tray having a plurality of ice-forming compartments;

a duct system having vertically aligned upper and lower baffles, wherein the upper baffle directs chilled air above the ice tray and the lower baffle directs chilled air below the ice tray, and further wherein the lower baffle includes a rim section extending upward at an angle and configured to direct the chilled air at a bottom side of the ice tray;

a deflector operably coupled with the upper baffle, wherein the deflector is laterally offset from the upper baffle;

a transition portion extending diagonally between the upper baffle and the deflector; and a diverter disposed between the deflector and the ice tray, the diverter defining a plurality of variously sized slots therein.

2. The icemaker of claim 1, wherein the plurality of variously sized slots includes a first slot and a second slot having an area less than the first slot, the second slot disposed on an opposing side of the first slot from the duct system.

3. The icemaker of claim 2, wherein the plurality of variously sized slots includes a third slot having an area less than the second slot, the third slot disposed on an opposing side of the second slot from the first slot.

4. The icemaker of claim 1, wherein the body portion of the deflector extends over at least a portion of the ice tray.

5. The icemaker of claim 4, further comprising:

a thermistor operably coupled with the ice tray.

6. The icemaker of claim 1, further comprising:

a water outlet disposed over the ice tray and positioned on an opposing side of the deflector from the duct system.

7. The icemaker of claim 6, further comprising:

a heater disposed on the water outlet and configured to produce heat.

8. The icemaker of claim 1, wherein the ice tray is laterally spaced apart from the lower baffle.

9. An icemaker for a refrigerated appliance, the icemaker comprising:

an ice tray having a plurality of ice-forming compartments;

a duct system having vertically aligned upper and lower baffles, wherein the upper baffle directs chilled air in a horizontal direction above the ice tray, and further wherein the lower baffle includes a rim section that extends upward at an angle and is configured to direct the chilled air at a bottom side of the ice tray;

a deflector operably coupled with the upper baffle;

a transition portion offset and extending substantially diagonally from the deflector; and a diverter disposed between the deflector and the ice tray, wherein the diverter defines a plurality of elongated slots.

10. The icemaker of claim 9, further comprising:

a thermistor operably coupled with the ice tray.

11. The icemaker of claim 9, wherein an ice bin is disposed below the ice tray and a return vent is disposed proximately to the ice bin.

12. The icemaker of claim 9, wherein a top surface of the body portion of the deflector extends in a substantially parallel direction to the ice tray.

13. The icemaker of claim 9, wherein a top surface of the body portion of the deflector includes a first section that extends in a substantially parallel direction to the ice tray and a second section that is offset from the first section.

14. The icemaker of claim 9, wherein the plurality of slots includes a first slot and a second slot having an area less than the first slot, the second slot disposed on an opposing side of the first slot from the duct system.

15. The icemaker of claim 9, wherein the ice tray extends further from the duct system than the deflector.

16. An icemaker for a refrigerated appliance, the icemaker comprising:

an ice tray having a plurality of ice-forming compartments;

a duct system having vertically aligned upper and lower baffles, wherein the upper baffle directs chilled air above the ice tray, and further wherein the lower baffle includes a rim section that extends upward at an angle and is configured to direct the chilled air at a bottom side of the ice tray; and a diverter disposed above the ice tray and defining a plurality of elongated slots of varying widths therein.

17. The icemaker of claim 16, further comprising:

a deflector operably coupled with the upper baffle, wherein the diverter is disposed between the ice tray and the deflector.

18. The icemaker of claim 17, wherein the ice tray extends further from the duct system than the deflector.

19. The icemaker of claim 17, further comprising:

a water outlet disposed over the ice tray and positioned on an opposing side of the deflector from the duct system.

20. The icemaker of claim 16, wherein the plurality of slots includes a first slot and a second slot having an area less than the first slot, the second slot disposed on an opposing side of the first slot from the duct system.

* * * * *